United States Patent [19]

Mowry, Jr.

[11] Patent Number: 4,733,887

[45] Date of Patent: Mar. 29, 1988

[54] SECURE FINANCIAL DOCUMENT

[75] Inventor: William H. Mowry, Jr., Ionia, N.Y.

[73] Assignee: The Standard Register Company, Dayton, Ohio

[21] Appl. No.: 941,416

[22] Filed: Dec. 15, 1986

Related U.S. Application Data

[63] Continuation-in-part of Ser. No. 794,986, Nov. 4, 1985.

[51] Int. Cl.[4] ..... B42D 15/00; G09F 7/00

[52] U.S. Cl. ..... 283/58; 283/57; 283/59; 434/194

[58] Field of Search ..... 283/57, 58, 59, 902; 235/17, 3; 282/DIG. 1; 356/432; 434/194; 54/61, 70; D19/11, 12; D18/5

[56] References Cited

U.S. PATENT DOCUMENTS

| | | | |
|---|---|---|---|
| 477,038 | 6/1892 | Wood | 283/57 |
| 936,399 | 10/1909 | Angell | 283/58 |
| 3,590,015 | 4/1976 | Shrock | 283/57 |
| 4,264,210 | 4/1981 | Mitsuhashi | 356/432 |
| 4,614,365 | 9/1986 | Tresser | 283/59 |

FOREIGN PATENT DOCUMENTS

| | | | |
|---|---|---|---|
| 376353 | 8/1907 | France | 283/58 |
| 1130211 | 5/1962 | Netherlands | 283/58 |
| 4119 | of 1903 | United Kingdom | 434/194 |

*Primary Examiner*—E. R. Kazenske
*Assistant Examiner*—Paul M. Heyrana, Sr.
*Attorney, Agent, or Firm*—Killworth, Gottman, Hagan & Schaeff

[57] ABSTRACT

A financial instrument has an amount printed on its face in which the digits making up the amount are printed in a negative pattern. The digits are formed by a series of rows of printed dots which define the outlines of the digits. To make alteration of the amount more difficult, each of the digits includes a boundary portion formed by a single row of dots which makes up a portion of the outline of each of the adjoining digits.

13 Claims, 25 Drawing Figures

SECURE FINANCIAL DOCUMENT

BACKGROUND OF THE INVENTION

This application is a continuation-in-part of my copending patent application Ser. No. 794,986, which was filed on Nov. 4, 1985.

Many techniques have been proposed to protect financial documents such as checks and money orders from having the amount raised by alteration. Safety papers have been developed which have chemically reactive coatings which can change color or bleach out a color and reveal words such as "VOID" to show that an attempt has been made to alter the document. Printing techniques have also been used on the back of documents using an ordered large repeating pattern, any change in which should be quickly detected by the human eye.

Several patents disclose various methods for providing secure financial instruments. For example, Todd, U.S. Pat. No. 1,564,724 discloses a commercial paper instrument having solid, positive numerical characters which are printed with a field of words. Preferably, the field of words for each numerical figure is formed by printing a repetition of groups of letters spelling the corresponding figure word, so that the field is different for each numerical figure. Todd's figures are preferably limited or terminated by other characters or words for the purpose of preventing the changing of the inscription by adding or inserting other figures.

Angell, U.S. Pat. No. 939,399, discloses a method of protecting commercial paper which utilizes a die set to form figures by cutting into or indenting paper in an area surrounding a numeral or letter, while leaving the area corresponding to the numeral or letter untouched. The surrounding, die impressed areas are constructed so that their exterior outlines are varied. This variation in the exterior outlines and the spacing between figures cooperates so that clear or blank portions of the paper intervene between adjacent figures.

Tonges et al, U.S. Pat. No. 4,175,774 discloses a document having a printed background which, upon copying by a photocopy machine, produces a document which can be readily distinguished from the original. To achieve this feature, the background of Tonges' document is printed with a set of larger dots and a set of smaller dots. The larger dots are of a size which can be reproduced by a copying machine. The smaller dots are of a size that the copying machine cannot reproduce.

Also of interest is French Brevet D'Invention No. 692,505.

Although not relating to methods for protecting the amount figure of a security document, several other patents disclose subject matter of interest. For example, Lee, U.S. Pat. No. 4,234,214 discloses a combination of alphanumeric characters for use in forming a serial number of a bank note. An ink jet printer is used to form a multi-colored or patterned field which defines a negative alphanumeric character. Burros, U.S. Pat. No. 3,112,151 relates to a method for correcting mistakes in magnetically encoded characters, such as the magnetically readable characters typically found on the bottom portion of a check. Baker, U.S. Pat. No. 3,983,814 relates to a font of alphanumeric characters which are believed to be more easily readable than conventional characters.

Notwithstanding the above described efforts to make financial documents more secure, techniques still exist for altering checks and money orders. In order to frustrate financial document protection techniques, such as those discussed above, persons interested in altering a check or money order have developed a cut and paste scheme. In the cut and paste method of alteration a person would go to a bank, store or post office and get two money orders. One money order could be for $9.00 and the second for $100.00. Using a scalpel the person would carefully remove the 9 from the first money order and the 1 from the second. The 9 would then be pasted into the area where the 1 had been removed thereby raising the money order to $900.00. On presenting the money order for cashing, the paper stock would not appear unusual, thereby not alerting the clerk that an alteration had been made.

Accordingly, there still exists a need in the art for a financial document and method of preparation which makes alteration of the monetary amount difficult and readily detectable.

SUMMARY OF THE INVENTION

The present invention meets that need and relates to a method of preparing secure financial instruments, and to the secure financial instruments so prepared. According to the present invention, a unique set of digits are used to enter the amount on the financial instrument. The digit set for the major amount, such as dollars, is printed in a negative (white on black) pattern, and is preferably formed by a series of rows of printed dots which define the outline of the digits of the digit set.

Preferably, the area of the financial instrument upon which the major amount is printed, is itself preprinted with an intelligible message which is visible through the open areas of the digits. Additionally, the major amount digit set can define a plurality of adjoining digits in which a single row of vertical dots forms at least a portion of the outline for each of the adjoining digits.

The minor amount, such as cents, is printed in a smaller, positive (black on white) pattern. The terms "white on black" and "black on white" are relative since the "white" could be the same as the background colors on the instrument while the "black" depends on the printing ink used and color developed on the paper. Each of the digits from 0 through 9 has a distinct size and shape which prevents one digit from being superimposed or pasted onto a document in place of another without the attempted alteration being clearly visible. The digits can be added to a blank instrument through the use of programmable printers. A dot matrix printer is preferred in view of the infinitely variable print available.

In the preferred embodiment of the present invention, a dot matrix printer is used in combination with a conventional print ribbon having a penetrating oil in the ink vehicle to wet the paper fibers. In adding the amount to the financial instrument, the printer would also add a word or symbol such as "PAY ONLY" to the immediate left of the highest order number. No additional higher order numbers can then be added in an attempt to raise the value of the instrument.

Accordingly, it is an object of the present invention to provide a secure financial document and method of preparation which makes alteration of the monetary amount of the document difficult and readily detectable. This, and other objects and advantages of the invention will become apparent from the following detailed description, the accompanying drawings, and the appended claims.

BRIEF DESCRIPTION OF THE DRAWINGS

FIGS. 2A through 2J illustrate a positive pattern digit set used for minor denominations on the financial instrument of the present invention;

DETAILED DESCRIPTION OF THE PREFERRED EMBODIMENT

Figure 1A:
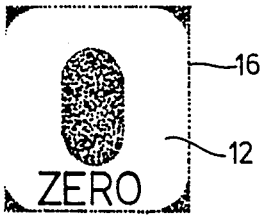
FIGS. 1A through 1J illustrate a negative pattern digit set used for major denominations on the financial instrument of the present invention.
Figure 1B:
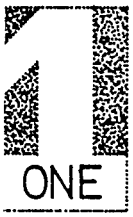
Figure 1C:
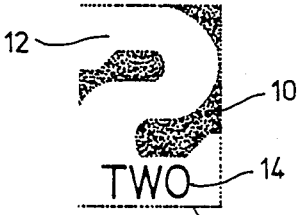
Figure 1D:
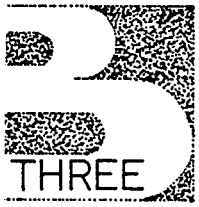
Figure 1E:
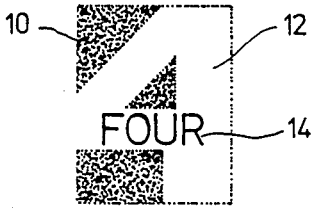
Figure 1F:
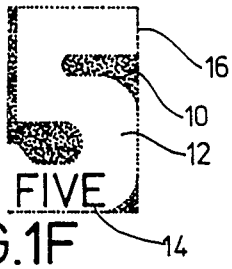
Figure 1G:
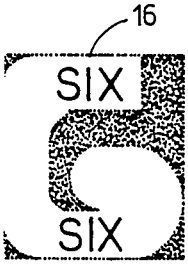
Figure 1H:
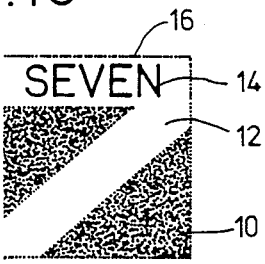
Figure 1I:
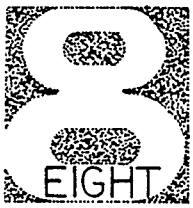
Figure 1J:
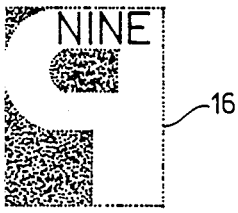
Figure 2A:
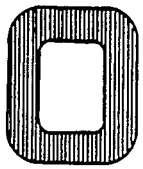
Figure 2B:
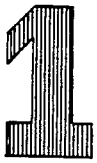
Figure 2C:
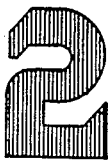
Figure 2C:
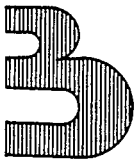
Figure 2E:
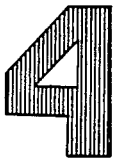
Figure 2F:
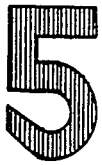
Figure 2F:
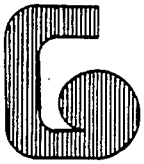
Figure 2H:
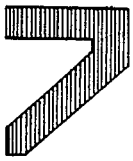
Figure 2I:
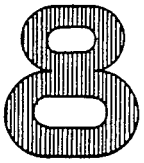
Figure 2J:
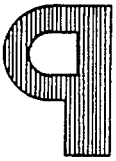

In FIGS. 1A through 1J the individual digits of a number set of the present invention are shown. Each of the digits 0 through 9 has distinct size and shape and has a unique area included within a rectangle bounding the configuration of the digit. To assist in identification, the name of each digit can be included within the configuration. The English language names are illustrated in FIGS. 1A through 1J. The digit names can be changed to correspond to the language of any country where the number set is used. Each of the digits of the digit set for the major amount is formed in a negative pattern. The digits are formed by a series of rows of dots printed by a dot matrix printer, preferably in the printer's graphics mode.

The rows of printed dots define the outline for the digits. Thus, each of the digits so formed by the negative printing pattern of the present invention includes three portions: the background portion 10 comprising the rows of printed dots, the open area number portion 12 defined by the outline of the background portion 10, and the name portion 14 which consists of the printed name of the particular number. Additionally, the background portion 10 of each digit includes a boundary portion 16 comprising a single row of printed dots. The boundary portion 16 forms at least a portion of the outline of each digit, and aids in increasing the difficulty of altering the digit when printed in combination with adjoining digits as more fully described below.

Several advantages are obtained by the use of negative pattern digits. One advantage is that the negative pattern make alteration more difficult. The negative pattern digits of the present invention are difficult to alter because excess ink has to be removed from or added to the financial document in order to alter a digit. It is very difficult to remove ink from a document without damaging the document. Also, it is difficult to add ink to the document which will match the ink of the existing digits. The use of negative pattern digits also allows intelligible, printed messages, which are preprinted on the document, to be seen in the number portions 12 of the digits.

The digits of the present invention are preferably printed with a dot matrix printer (not shown) in the printer's graphics mode. The characteristics of the printing performed by a dot matrix printer increase the difficulty of altering the digits so printed. A dot matrix printer forms the digits from a pattern of pin strikes which form an array of dots. Generally, the horizontal spacing between the dots will be different than the vertical spacing between the dots. Although the dots are spaced closely together, a series of voids still exist between the dots which permit the background color of the document to be seen through the background portion 10 of the digits. The voids prevent the background portion 10 of the digits from appearing as a solid mass of printing. Thus the presence of the voids renders more difficult the forger's task of duplicating the background portion 10 of the digit, by imparting a unique texture to the document. The unique texture created by the voids also helps to prevent alteration techniques using photocopying. Many photocopying machines do not have sufficient resolution capabilities to be able to reproduce the rather small voids rendering the voids substantially incapable of faithful reproduction. The background portion 10 is reproduced as a solid mass of printing.

Additionally, by use of a dot matrix printer to form the outline of the digits, a single vertical row of dots can be utilized to form at least a portion of the outline of adjoining digits. As illustrated in FIGS. 1A through 1J, all of the digits have some portion of their respective left edges open when standing alone. The left edge is closed by the last row of dots on the right edge of the left adjacent digit when printed. Thus, boundary portion 16 of each digit will form at least a portion of the outline of an adjoining digit when the digits are printed on the financial instrument. This further increases the difficulty of altering digits on the instrument by the "cut and paste" method.

FIGS. 2A through 2J illustrate the second, minor digit set of the present invention. Each of the minor digits 0 through 9 has a distinct size and shape and has a unique area included within a rectangle bounding the configuration of the digit. The minor digit set is also intended to be colored and have a substantial contrast to the major digit set of FIGS. 1A through 1J. Similar to the background portions of the major digits, the number portions 18 of the minor digits are formed by a series of dots printed by a dot matrix printer. Preferably, the minor digits are of a different size than that of the major digits, as shown in FIGS. 3 and 7.

Figure 3:
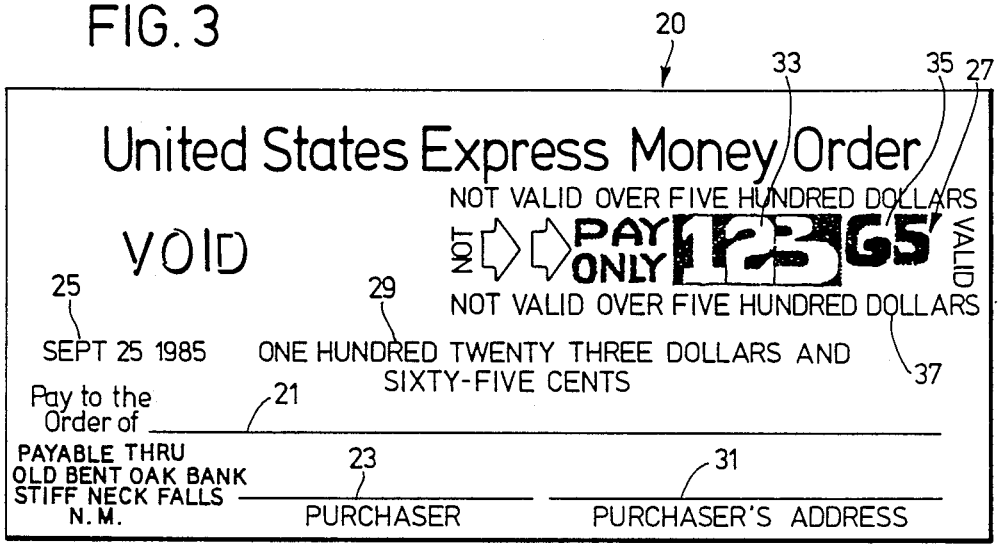
FIG. 3 is a plan view of a financial instrument illustrating the use of the digit sets of FIGS. 1 and 2 to enter a sum of money.

In FIG. 3, a representative negotiable instrument 20 is shown having a line 21 for the identification of the payee. A line 23 is provided for the identification of the payor or purchaser, and a place 25 is provided for the date the negotiable instrument 20 was prepared. The instrument 20 also includes an area 27 for the entry of the amount or value of the negotiable instrument 20, and a place 29 where the same amount or value is spelled out. An area 31 is provided for entering the address of the payor or purchaser.

The amount or value of the negotiable instrument is shown as having been entered onto area 27 through the use of the negative pattern digit sets of the present invention. The major amount 33 (in this example $123), has been entered using the negative major digits of FIG. 1, and the minor amount 35, (in this example 87 cents), has been entered using the positive, minor digits of FIG. 2.

Figure 7:
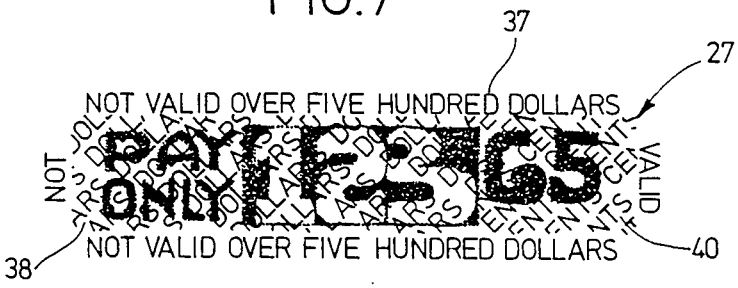
FIG. 7 is an enlarged view of the digit set-containing portion of the document of FIG. 3.

As best shown in FIG. 7, the area 27 of the document 20 in which the major and minor amounts 33, 35 are placed is preprinted with an intelligible message. In the embodiment shown, the intelligible message comprises the word "dollars" repetitively printed in variably spaced angled rows 38 in the portion of area 27 where the major amount 33 digits are placed, and the word "cents" repetitively printed in variably spaced angled rows 40 in the portion of area 27 where the minor amount 35 digits are placed. This variable spacing of intelligible messages makes alteration by cutting and pasting difficult since it will be nearly impossible for a forger to align partial backgrounds cut from different places on that or another instrument. The major 33 and minor 35 amount digits are printed over the respective rows 38, 40, of the intelligible message. As the major digits 33 are printed in a negative pattern, the rows of 38 of the intelligible message can be seen in the number portions 12 of the major amount digits 33. If one were to attempt to alter the amount of the document by pasting an unauthorized major digit over the actual major digit, it is highly unlikely that the intelligible message rows 38 of the unauthorized major digit would align perfectly with the rows of the document 20 onto which the unauthorized digit was placed, thus making the alteration easier to detect.

Although the major digit amount 33 is shown in the drawings as appearing in a white on black configuration, and the minor digit 35 appears in a black on white configuration, it will be understood that the "white on black" and "black on white" configurations are relative. When the major amount 33 is entered on a negotiable instrument, the background color in the area 27 will be the color appearing within the bounds of the digits. The color of the ink used in the printer along with any color formed in the area 27 through the use of a carbonless color developing system will determine the ultimate color of the "black" used to enter the minor digits 35.

For further document security the area 27 can be enclosed within a printed border 37 which sets forth the maximum amount which can be entered on the negotiable instrument. Also, immediately to the left of the highest order major digit 33 a mark or words such as "PAY ONLY" may be used to prevent still higher order digits from being entered.

Figure 4:
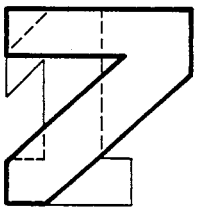
FIGS. 4, 5 and 6 illustrate the effect produced in attempting to raise a digit of the number sets by superimposing a higher order digit over a lower order digit.
Figure 5:
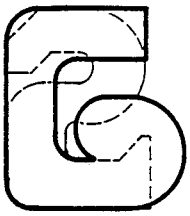
Figure 6:
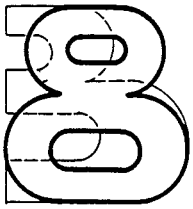

As shown in FIG. 4, if an attempt is made to raise the amount of the negotiable instrument 20 by superimposing a higher order digit, for example by using a 7 to replace the 1, it can be clearly seen that the alteration would be clearly visible due to the substantial difference in size and shape of the two digits. If the 1 was removed from the area 27 by the so called "cut and paste" technique, the difference in the size, shape and included rectangular area is such that the attempted alteration would be clearly visible. FIGS. 5 and 6 further illustrate the difference between digits with substantially similar major features. Even these digits would clearly show any attempt to alter the lower order digit.

In the example presented herein the English language has been used for the amount of the negotiable instrument and for a symbol such as "PAY ONLY". In countries where other languages are in use these same entries could be made in the appropriate language. Likewise the selection of a particular number set for the major and minor amount is a matter of choice. The preferred embodiment is to use the number sets and color order as shown herein in relation to the example of FIG. 3.

Having described the invention in detail and by reference to preferred embodiments thereof, it will be apparent that modifications and variations are possible without departing from the scope of the invention defined in the appended claims.

What is claimed is:

1. A financial instrument having an amount printed on the face thereof in which the digits making up the amount are printed in a negative pattern and formed by a series of rows of printed dots which define the outlines for said digits and in which the area beneath said amount is preprinted with an intelligible message which is visible through the open areas of said digits.

2. The financial instrument of claim 1 wherein said amount defines a plurality of adjoining digits in which a single vertical row of dots forms at least a portion of the outline for each of said adjoining digits, thereby making alteration of said amount difficult.

3. The financial instrument of claim 1 wherein sufficient spacing is provided between said rows of dots to create a series of voids through which the color of said face of said instrument can be discerned.

4. The financial instrument of claim 3 wherein said voids are sufficiently small to render the voids substantially incapable of faithful reproduction by photocopying.

5. The financial instrument of claim 1 wherein the amount further comprises minor amount digits printed in a positive pattern formed by a series of rows of printed dots.

6. The financial instrument of claim 1 wherein each of said digits printed in a negative pattern includes an open area wherein the name of the digit is printed.

7. The financial instrument of claim 1 further comprising minor amount digits printed in a positive pattern formed from a row of dots, said minor amount digits being of a size different than the size of said digits printed in a negative pattern.

8. A financial instrument having an amount printed on the face thereof in which the digits making up the amount are printed in a negative pattern and formed by a series of rows of printed dots which define the outlines for said digits and wherein said amount defines a plurality of adjoining digits in which a single vertical row of dots forms at least a portion of the outline for each of said adjoining digits, thereby making alternation of said amount difficult.

9. The financial instrument of claim 8 wherein sufficient spacing is provided between said rows of dots to create a series of voids through which the color of said face of said instrument can be discerned.

10. The financial instrument of claim 9 wherein said voids are sufficiently small to render the voids substantially incapable of faithful reproduction by photocopying.

11. The financial instrument of claim 8 wherein the amount further comprises minor amount digits printed in a positive pattern formed by a series of rows of printed dots.

12. The financial instrument of claim 8 wherein each of said digits printed in a negative pattern includes an open area wherein the name of digit is printed.

13. The financial instrument of claim 8 further comprising minor amount digits printed in a positive pattern formed from a row of dots, said minor amount digits being of a size different than the size of said digits printed in a negative pattern.

* * * * *